US010844811B2

(12) United States Patent
Koch et al.

(10) Patent No.: US 10,844,811 B2
(45) Date of Patent: Nov. 24, 2020

(54) INTERNAL COMBUSTION ENGINE WITH A VALVE AND A FLUID-CARRYING COMPONENT AND A METHOD FOR MONITORING A CONNECTION BETWEEN A VALVE IN A TANK VENTILATION LINE AND A FLUID-CARRYING COMPONENT

(71) Applicant: Volkswagen Aktiengesellschaft, Wolfsburg (DE)

(72) Inventors: Johannes Koch, Braunschweig (DE); Torsten Baranski, Braunschweig (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 0 days.

(21) Appl. No.: 16/570,595

(22) Filed: Sep. 13, 2019

(65) Prior Publication Data

US 2020/0088140 A1 Mar. 19, 2020

(30) Foreign Application Priority Data

Sep. 14, 2018 (DE) ..... 10 2018 215 648

(51) Int. Cl.
*F02M 25/08* (2006.01)
*F02M 37/00* (2006.01)

(52) U.S. Cl.
CPC .... *F02M 25/0836* (2013.01); *F02M 25/0872* (2013.01)

(58) Field of Classification Search
CPC ..... F02M 25/0836; F02M 25/089; F02M 25/0818; F02M 21/0239; F02M 69/54; F02M 2200/16; F02M 2200/46; F02M 25/08; F02M 37/0076; F02M 61/182
See application file for complete search history.

(56) References Cited

U.S. PATENT DOCUMENTS 4,703,737 A * 11/1987 Cook ..... F02M 25/0836 123/518
5,191,870 A * 3/1993 Cook ..... F02M 25/0809 123/198 D
5,621,176 A 4/1997 Nagano et al.
(Continued)

FOREIGN PATENT DOCUMENTS

DE 10 2015 209 651 A1 12/2016
DE 10 2016 210 579 A1 12/2016
(Continued)

*Primary Examiner* — Long T Tran
(74) *Attorney, Agent, or Firm* — Muncy, Geissler, Olds & Lowe, P.C.

(57) ABSTRACT

An internal combustion engine with a fuel tank, a fluid-carrying component and a tank ventilation line, which fluidically connects the fuel tank and the fluid-carrying component, wherein a valve is disposed in the tank ventilation line, wherein a detection subarea of the valve is surrounded by the fluid-carrying component in such a manner that a detection space is formed around the detection subarea, wherein the detection space has at least one inlet opening via which the detection space can be pressurized and wherein at least one pressure sensor for monitoring the pressure in the detection space is provided. A method for monitoring a connection between a valve in a tank ventilation line and a fluid-carrying component is also provided.

8 Claims, 5 Drawing Sheets

(56) References Cited

U.S. PATENT DOCUMENTS

| | | | | |
|---|---|---|---|---|
| 5,970,958 | A * | 10/1999 | DeLand | F02M 25/0836 123/520 |
| 6,050,245 | A * | 4/2000 | Cook | F16K 37/005 123/520 |
| 6,343,505 | B1 * | 2/2002 | Cook | F02M 25/0809 73/114.39 |
| 9,752,539 | B2 | 9/2017 | Burleigh et al. | |
| 2003/0089345 | A1 * | 5/2003 | Itou | F02M 25/0836 123/520 |
| 2004/0000187 | A1 | 1/2004 | Kobayashi et al. | |
| 2006/0016253 | A1 | 1/2006 | Kobayashi et al. | |
| 2006/0185652 | A1 * | 8/2006 | Tsuge | F16K 1/34 123/519 |
| 2013/0247880 | A1 * | 9/2013 | Plymale | F02D 41/004 123/519 |
| 2015/0252756 | A1 | 9/2015 | Itoh et al. | |
| 2019/0345898 | A1 * | 11/2019 | Schwinn | B01D 53/0454 |

FOREIGN PATENT DOCUMENTS

| | | |
|---|---|---|
| DE | 10 2018 111 116 A1 | 11/2019 |
| EP | 3 181 885 A1 | 6/2017 |

* cited by examiner

INTERNAL COMBUSTION ENGINE WITH A VALVE AND A FLUID-CARRYING COMPONENT AND A METHOD FOR MONITORING A CONNECTION BETWEEN A VALVE IN A TANK VENTILATION LINE AND A FLUID-CARRYING COMPONENT

This nonprovisional application claims priority under 35 U.S.C. § 119(a) to German Patent Application No. 10 2018 215 648.4, which was filed in Germany on Sep. 14, 2018, and which is herein incorporated by reference.

BACKGROUND OF THE INVENTION

Field of the Invention

The present invention relates to an internal combustion engine with a fuel tank, a fluid-carrying component and a tank ventilation line, wherein a valve is arranged in the tank ventilation line. In particular, the invention relates to a motor vehicle with such an internal combustion engine. The invention further relates to a method for monitoring a connection between a valve in a tank ventilation line and a fluid-carrying component.

Description of the Background Art

From DE 10 2015 209 651 A1, a tank ventilation system with an adsorption filter is known, wherein a line connects the adsorption filter with an air supply system of an internal combustion engine. In the line, a pump is arranged and downstream of the pump is a throttle point and arranged parallel to the throttle point, a bypass line. If the line is properly installed, the bypass line is tightly sealed, and if not properly installed, the bypass line is open. Details on opening and closing the bypass line cannot be found in the document.

SUMMARY OF THE INVENTION

It is therefore an object of the present invention to provide an internal combustion engine with a valve and a fluid-carrying component as well as a method for monitoring a connection between a valve and a fluid-carrying component, by means of which a connection of the valve with the fluid-carrying component can be reliably checked with few components and little space requirement.

An internal combustion engine according to an exemplary embodiment of the invention has a fuel tank, a fluid-carrying component and a tank ventilation line connecting the fuel tank and the fluid-carrying component in a flow-conducting manner. In the tank ventilation line, a valve is arranged, which serves in particular for controlling the tank ventilation. A detection subarea of the valve is surrounded by the fluid-carrying component in such a manner that a detection space is formed around the detection subarea. The detection space has at least one inlet opening, via which the detection space can be subjected to pressure. In addition, at least one pressure sensor is provided for monitoring the pressure in the detection space.

Apart from the one inlet opening or the plurality of inlet openings, the detection space can be a closed space, i.e., a space that is closed or even suitably sealed with respect to other spaces, which may be accessible via gaps, as well as with respect to the environment that may be accessible via gaps, for example, by the appropriate arrangement of sealing elements. The detection space by the surrounding fluid-carrying component can be integrally formed with a particularly small space requirement, in the simplest case only by an appropriate structural design of the individual elements and optionally by the complementary arrangement of suitable sealing elements.

In practice, the valve is used in particular for controlling tank ventilation, wherein when the valve is open, tank gases flow from the fuel tank via the tank ventilation line through the valve into an intake line and accordingly, the fuel tank is vented, or an activated carbon canister arranged in the tank ventilation line is regenerated. When the valve is closed, a flow of tank ventilation gases into the intake line is prevented. In practice, valves used for tank ventilation as described above are often so uniquely positioned that they may be damaged during repair or maintenance or that the connection between the valve and the fluid-carrying element is at least partially released. In addition, age-related and material fatigue-related damage to the valve or the fluid-carrying component is possible.

The detection subarea of the valve extends in the flow direction S as viewed over the same length as the detection space. In particular, the detection subarea extends only over part of the length of the valve or over the entire length of the valve.

To be able to detect damage in the region of the detection subarea of the valve, and in particular, the actual mounting position of the valve on the fluid-carrying component when it deviates from a desired mounting position (i.e., in particular an at least partially released connection), the detection space is formed around the detection subarea of the valve. In particular, the detection subarea is a connecting piece or a portion of a connecting piece, which for connection to the fluid-carrying component is inserted into a corresponding recess formed in the former and is correspondingly surrounded by the fluid-carrying component. In particular, the valve is firmly connected to the fluid-carrying component by means of clips.

If the detection space is open to the environment due to damage to the detection subarea and/or an at least partial releasing of the connection between the valve and the fluid-carrying component, the gases which have reached the detection space via the inlet opening can escape from the detection space, so that there is a loss of pressure in the detection space which can be detected by the pressure sensor. In this case, a signal may be issued to the driver and/or a repair shop that possibly fuel-containing tank gases are leaking into the environment. If damage or malfunction in the detection subarea occurs, or the connection is released in such a way that the detection space is not open to the environment, then no fuel-containing tank ventilation gases can enter from the detection space into the environment. In this case, the detection space may be regarded as a protective sheath for the detection subarea.

The internal combustion engine according to the invention can reliably detect damages in the detection subarea of the valve or an at least partially released connection between the valve and the fluid-carrying component, in particular also those where fuel-containing gases can enter the environment.

The fluid-carrying component can be an intake hood or a compressor of an exhaust gas turbocharger. In this case, the fuel-containing tank ventilation gases flowing out of the valve either flow through the intake hood, which is in fluid communication with the exhaust gas turbocharger, directly into an intake line upstream of an exhaust gas turbocharger or directly into the compressor. The intake hood or the compressor of the exhaust gas turbocharger are then in particular designed such that at least the detection subarea of the valve is surrounded such that the respective component (intake hood or compressor) at least partially forms a detection space.

The at least one inlet opening can be formed by at least one passage opening in the valve. In particular, the passage opening extends from an inner through-flow passage in the valve to an outer side of the valve, so that the detection space is pressurized by the tank ventilation gases flowing through the valve. The at least one passage opening is in particular located upstream of a sealing element (such as a valve plate) disposed in the valve, so that even when the valve is closed, pressurization of the detection space can take place. The formation of the inlet openings in the valve is a particularly space-saving solution since no additional lines are needed. By forming the inlet opening using a passage opening, preferably several passage openings are distributed over the circumference of the valve, which open into the detection space. The sum of the cross-sectional opening areas of all the inlet openings or passage openings can correspond to the cross section of a circular opening with a diameter of 5 mm to 15 mm, at least 7 mm to 13 mm, more preferably 8 mm to 12 mm, and particularly preferably 10 mm+/−1 mm.

In a structurally particularly simple embodiment, the at least one passage opening extends in the flow direction. In this case, the main flow direction of the tank ventilation gases through the valve is regarded as the flow direction. In particular, the at least one passage opening extends in the demolding direction of the valve. This is particularly advantageous for valves which are produced by means of a primary molding process with an at least two-part mold, in particular in the plastic injection molding process, because such passage openings can be easily and therefore cost-effectively formed or demolded.

In particular, sealing elements are provided in gaps adjacent to the detection space. Thus, in a desired mounting position of the valve, the detection space is sealed on the fluid-carrying component against the environment and can be pressurized via the inlet opening. In particular sealing rings, particularly O-rings, serve as sealing elements, which are arranged on the detection subarea of the valve and/or in the area of the fluid-carrying element surrounding the detection space. Preferably, at least two spaced sealing elements are provided on the detection subarea and the at least one inlet opening opens between the two sealing elements into the detection space. The sealed detection space is thus formed upon establishing the connection between the valve and the fluid-carrying component.

As already described above, for purposes of pressurizing the detection space, the inlet opening is in particular fluidly connected to the tank ventilation line. The introduction of tank ventilation gases into the detection space preferably takes place through the at least one passage opening formed in the valve. Overall, there is thus no need for a separate or external source to be provided for the pressurization of the detection space, but rather, an already existing and in particular adjacent source is used.

A scavenging air pump can be provided in the tank ventilation line, which serves to pressurize the detection space. The scavenging air pump is usually used to deliver tank ventilation gases from the direction of the fuel tank in the direction of the intake line. The existing scavenging air pump can be used in this embodiment to pressurize the detection space, so that no further additional pressure sources are needed. Usually, a scavenging air pump is already used for checking damage to the tank ventilation line and in this embodiment, it is also advantageously used to check the connection between the valve and the fluid-carrying component.

Alternatively, or in addition, the pressure sensor can be arranged in the tank ventilation line. In particular, a pressure sensor already present in the tank ventilation line, which serves for detecting the pressure in the tank ventilation line, is likewise used to monitor the connection between the fluid-carrying component and the valve, whereby installation space and costs can be saved.

Furthermore, it is pointed out as an alternative or in addition to a passage opening formed in the valve that a separate pressure line can also be provided, which serves to pressurize the detection space. In particular, such a pressure line is fluidly connected to a pressure pipe downstream of a compressor and the pressure sensor is arranged in the pressure pipe.

The invention has been made in particular in connection with fluid-carrying components and/or valves in fluid-carrying components, which are completely or partially made of plastic. Precisely plastic components can become brittle after a longer service life due to the type of material and then suddenly fail. Such a failure can be reliably detected with the internal combustion engine according to the invention.

The invention also relates to a method for monitoring a connection between a valve in a tank ventilation line and a fluid-carrying component, wherein a detection subarea of the valve is surrounded by the fluid-carrying component in such a manner that a detection space is formed around the detection subarea, and wherein the detection space has at least one inlet opening. The method comprises the following method steps: shutting off of the valve, building up of test pressure in the tank ventilation line by means of a scavenging air pump arranged in the tank ventilation line, detecting the actual test pressure in the tank ventilation line by means of a pressure sensor, and comparing the built-up actual test pressure with a target test pressure.

To check the connection between the valve and the fluid-carrying component, a test pressure is built up in the tank ventilation line by means of the scavenging air pump and a closed valve. The test pressure is in particular an overpressure with respect to the ambient pressure. If the valve is intact or the valve and the fluid-carrying component are properly connected, the detection space is sealed against the environment and is pressurized only via the at least one inlet opening. No tank ventilation gases can escape through the detection space, and the actual test pressure in the detection space corresponds to the target test pressure, provided there are no further damages to the tank ventilation line. In the event of damage to the valve and the fluid-carrying component in the region of the detection subarea or if there is a released connection between the valve and the fluid-carrying component, wherein the detection space is open with respect to the environment, tank ventilation gases escape into the environment despite the closed valve via the inlet opening and the detection space, so that an actual test pressure occurs, which is lower than the target test pressure. This can be detected with the pressure sensor. Upon detection of such low actual test pressure, a signal is preferably issued alerting the driver and/or a repair shop that fuel-containing gases may be entering the environment. Overall, in the method according to the invention, an existing infrastructure made up of scavenging air pump and valve is used to check the connection between the valve and the fluid-carrying component.

In particular, the abovementioned method steps are carried out immediately after, before or during the start of an internal combustion engine. In this way, regular monitoring of the connection between the valve and the fluid-carrying component is achieved. Preferably, the monitoring is carried out during or after the start, so as to cover possible noise from the scavenging air pump by additional noise from the internal combustion engine. Alternatively, or in addition thereto, the abovementioned method steps are carried out immediately before or after the operating phases of the internal combustion engine in which tank ventilation takes place. In this case, the scavenging air pump is already in operation and it takes only at most a few seconds to build up pressure in the tank ventilation line and in the detection space when the valve is closed, so that a check of the connection between the valve and the fluid-carrying component can be made very quickly.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
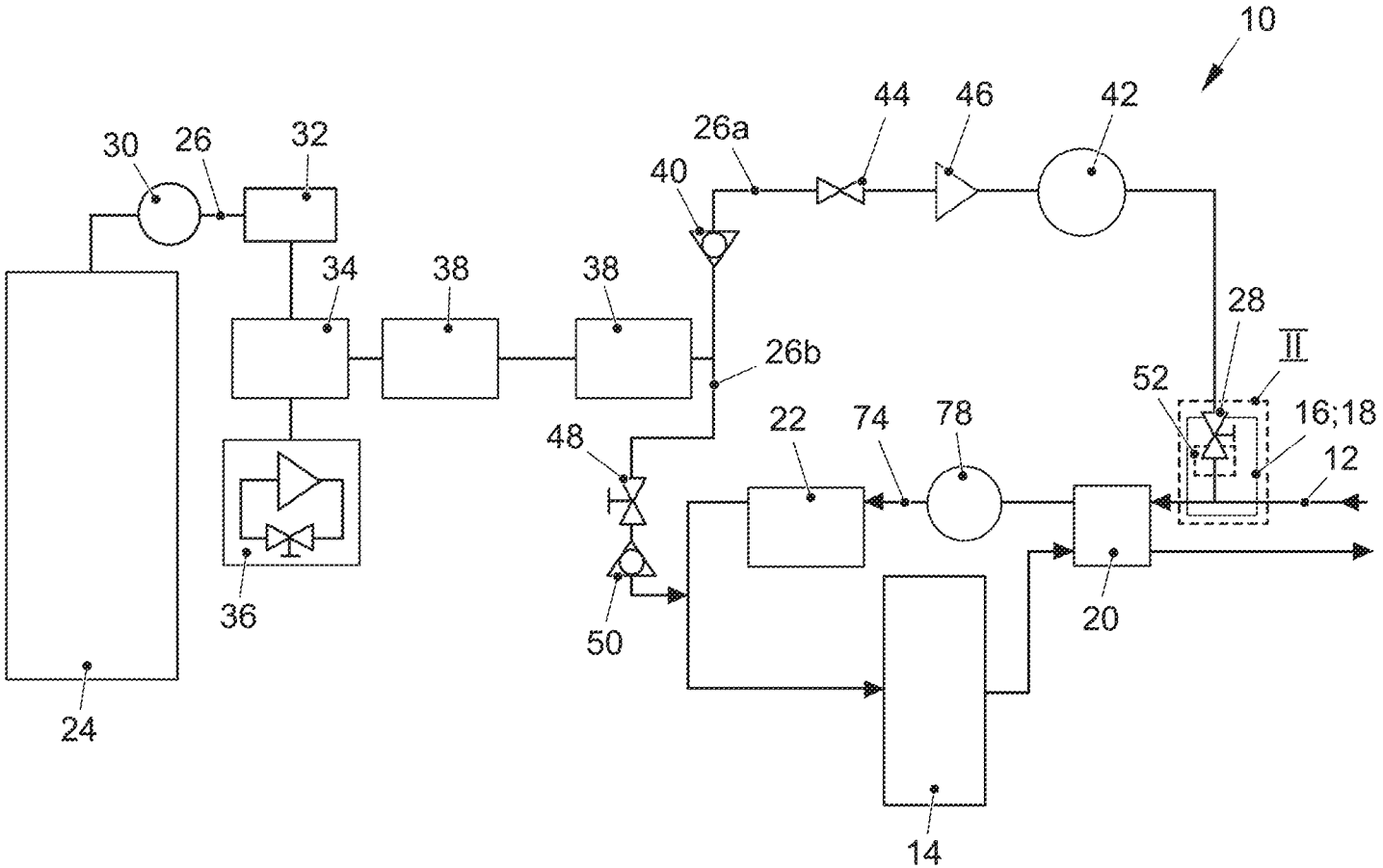
FIG. 1 shows an exemplary embodiment of an internal combustion engine according to the invention in a schematic representation.

FIG. 1 shows a schematic illustration of an internal combustion engine 10 according to the invention, wherein only those elements which are potentially relevant in connection with the invention will be explained in detail below.

In the internal combustion engine 10, an intake line 12 is provided via which fresh air from the atmosphere can be delivered in the direction of a combustion chamber 14. An intake hood 18 is provided as a fluid-carrying component 16 in the intake line 12. Downstream of the intake hood 18 are a compressor of an exhaust gas turbocharger 20 and a throttle valve 22.

Exhaust gas guided from the combustion chamber 14 flows through the exhaust gas turbocharger 20 in the direction of an exhaust system.

The internal combustion engine 10 also includes a fuel tank 24 which is vented via a tank ventilation line 26. A first branch **26*a* of the tank ventilation line 26 leads to a valve 28. A second branch 26*b* of the tank ventilation line 26 leads to the area downstream of the throttle valve 22**.

Further, in the path **26*a* of the tank ventilation line 26, a pressure and temperature sensor 30, a fuel tank isolation valve (FTIV) 32, an activated charcoal canister 34, a diagnostic module tank leakage (DMTL) 36, two pulsation dampers 38, a check valve 40, a switching valve 44, a further pressure sensor 42 and the valve 28 are arranged. Additionally, in the path 26*a* a scavenging air pump 46 is arranged. Optionally, a temperature sensor may also be located in the path 26*a***.

In the path **26*b*, a valve 48 and a check valve 50** are disposed.

As already shown schematically in FIG. 1 and as will be described in more detail below with reference to other figures, the valve 28 is at least partially surrounded by a detection space 52, shown in FIG. 1 only as a dashed box.

Figure 2:
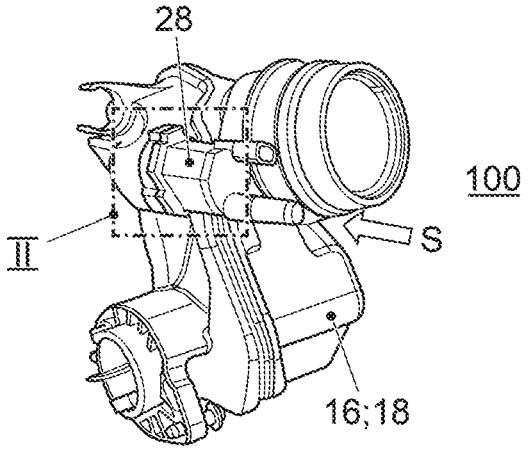
FIG. 2 shows the area marked II in FIG. 1 with a valve and an intake hood in a perspective view.
Figure 3:
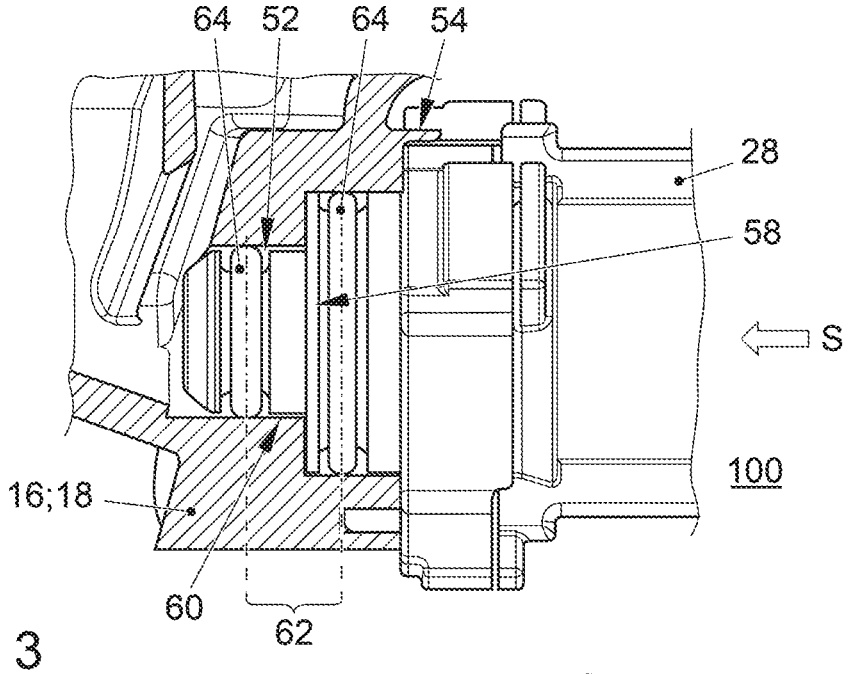
FIG. 3 shows the area marked III in FIG. 2 in a side view with a sectioned intake hood.
Figure 4:
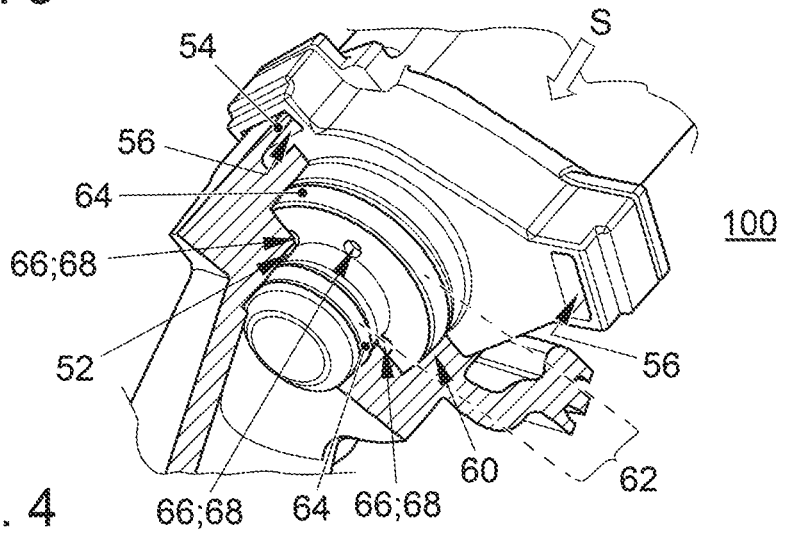
FIG. 4 shows the area III of FIG. 2 shown in FIG. 3 in a perspective view.
Figure 6:
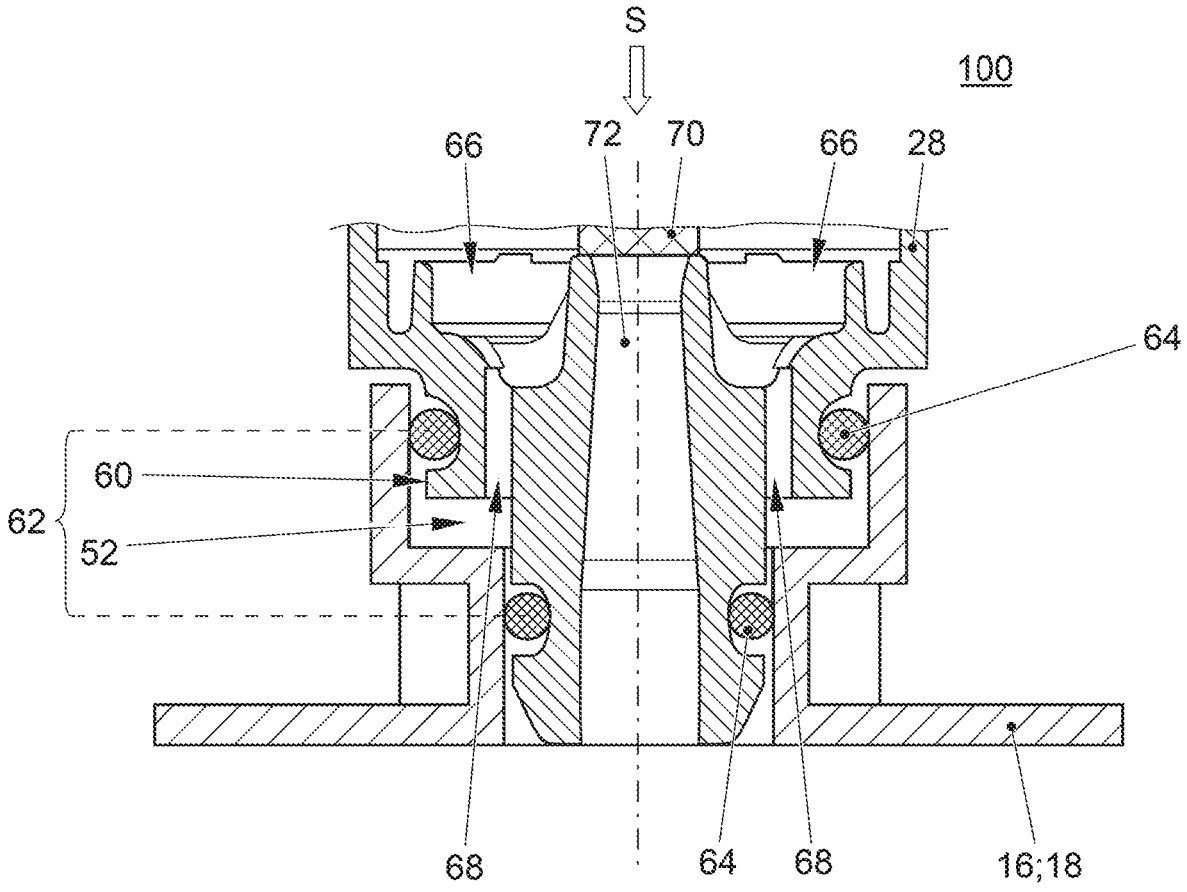
FIG. 6 shows the area marked III of FIG. 2 in a schematic sectional view.

In FIGS. 2 to 4 and in FIG. 6, the fluid-carrying component 16 is shown in the form of the intake hood 18 with the valve 28 arranged thereon. Tank ventilation gases flow through the valve 28 in the flow direction S. The valve 28 is firmly connected to the intake hood 18 by means of a clip connection with three clips 54 (in FIGS. 3 and 4, only one clip 54 can be seen) and corresponding clip openings 56. Here, the intake hood 18 and the valve 28 are made of plastic. As can be clearly seen in FIG. 3, the intake hood 18 has a recess 58 into which a connecting piece 60 of the valve 28 is introduced.

In the present case, a detection subarea 62 of the valve 28 is provided in the connecting piece 60, which is surrounded by the intake hood 18 in such a manner that the detection space 52 is formed around this detection subarea 62 between the valve 28 and the intake hood 18.

Figure 5:
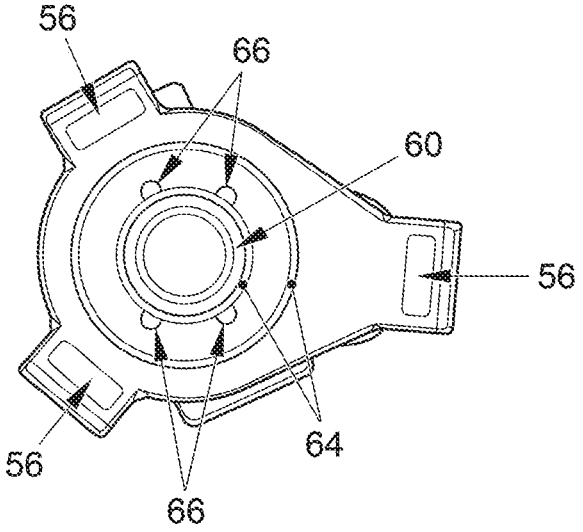
FIG. 5 shows the valve in a front view.

On the connecting piece 60, two sealing elements 64 are arranged in the form of O-rings, which limit the detection space 52 and close it sealingly. The detection space 52 thus extends in the gap between the valve 28 and the intake hood 18. To pressurize the detection space 52, four passage openings 66 distributed over the circumference of the valve 28 are formed in the valve 28 (see FIG. 5 and FIG. 6), which open into the detection space 52 and insofar serve as inlet openings 68 into the detection space 52. In the present case, the passage openings 66 extend in the main flow direction S, which also corresponds to the demolding direction of the valve 28 made of plastic.

FIG. 6 clearly shows that the passage openings 66 extend upstream of a sealing element 70, in this case a valve plate, of the valve 28. The passage openings 66 in the present case extend from an inner through-flow passage 72 to the outside of the valve 28 and open into the detection space 52 between the two sealing elements 64. In this first embodiment, the inlet openings 68 into the detection space 52 are fluidly connected with the tank ventilation line 26 and thereby with the path **26*a***.

The following explains how the connection between the valve 28 and the fluid-carrying component 16 can be checked.

With a proper connection between the valve 28 and the fluid-carrying component 16 or when the intake hood 18 is in a desired mounting position (see FIGS. 3 and 6), the detection space 52 is sealed against the environment 100 by means of sealing elements 64 arranged on the detection subarea 62. The detection space 52 is acted upon with pressure from the tank ventilation line 26 via the inlet openings 68, which are formed in the valve 28.

To check the connection, the valve 28 is closed by the sealing element 70 blocking the through-flow passage 72, and a test pressure is built up by means of the scavenging air pump 46 in the tank ventilation line 26. In the case of the sealed detection space 52, this test pressure also prevails in the detection space 52. By means of the pressure sensor 42 disposed in the tank ventilation line 26, the pressure in the tank ventilation line 26 is measured and checked as to whether the measured actual test pressure corresponds to a target test pressure.

If the connection between the valve 28 and the intake hood 18 is released in such a way that the detection space 52 is open to the environment 100, there is a pressure drop in the tank ventilation line 26 and the actual test pressure is lower than the target test pressure.

In conjunction with FIGS. 7 and 8, a second embodiment of the internal combustion engine 10 according to the invention is explained below. For identical or at least functionally identical elements, the same reference numerals are used as in the above description of the first embodiment.

For the description of the second embodiment, only the essential differences are discussed below.

Figure 7:
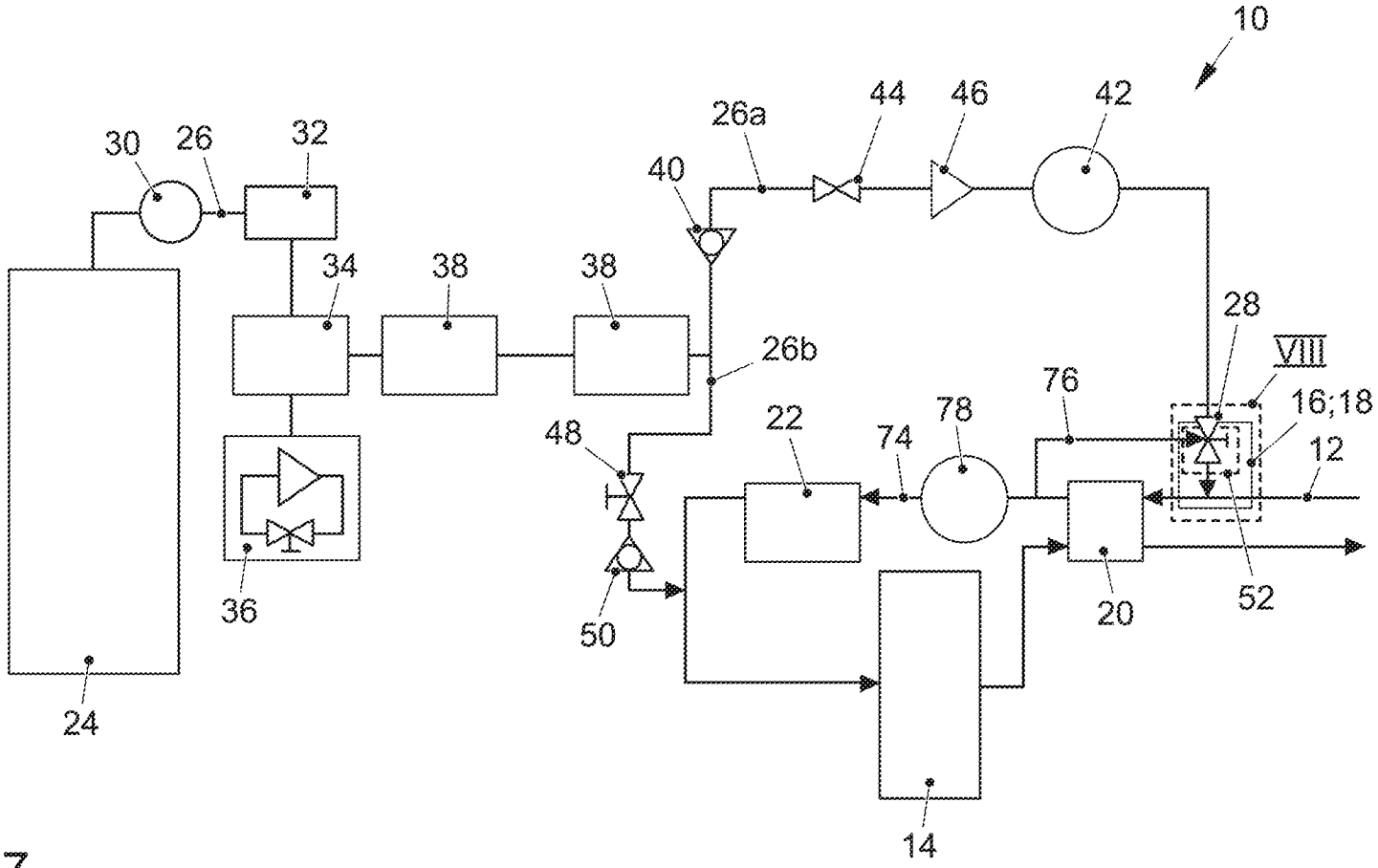
FIG. 7 shows an exemplary embodiment of an internal combustion engine according to the invention in a schematic representation and FIG. 8 shows the area marked VIII of FIG. 7 with a valve, an intake hood and a pressure pipe in a perspective view.
Figure 8:
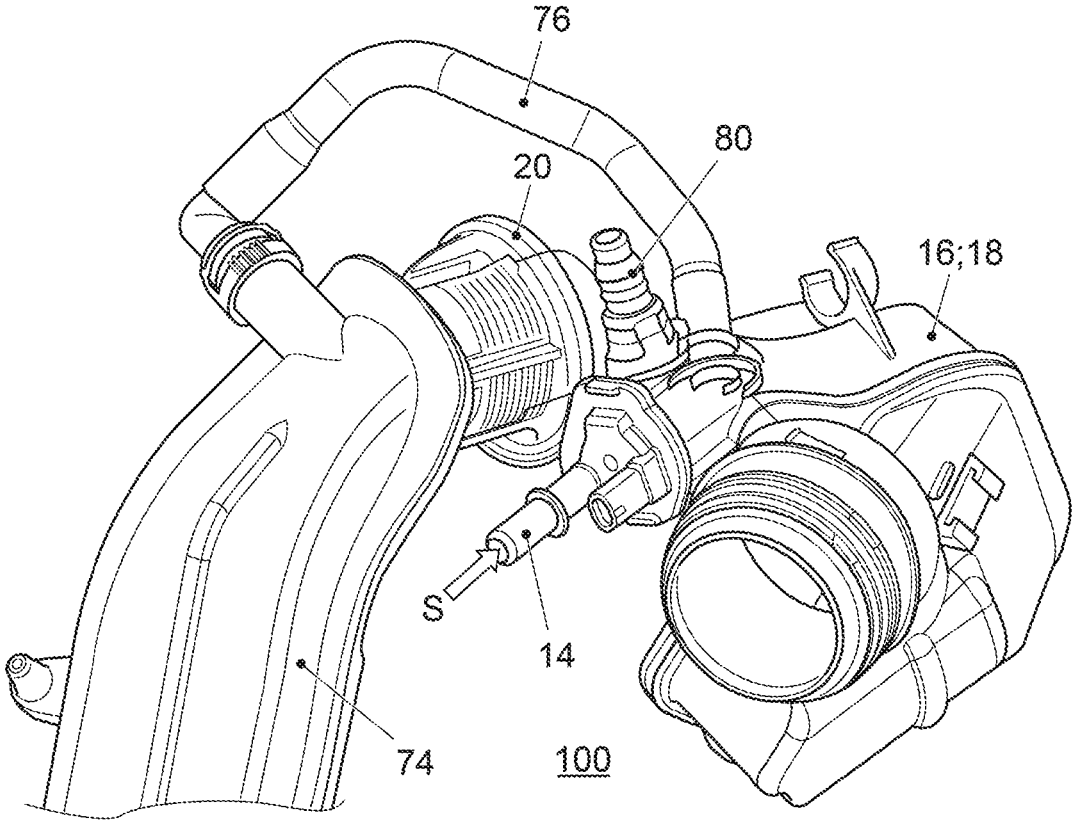

As shown in FIG. 7 and FIG. 8, a separate pressure line 76, which opens into the detection space 52, branches off downstream of the exhaust gas turbocharger 20, starting from a pressure pipe 74 extending between the exhaust gas turbocharger 20 and the throttle valve 22. To measure the pressure, a pressure sensor 78 is provided in the pressure pipe 74.

FIG. 8 shows a port 80 for the separate pressure line 76, wherein the pressure line 76 in the present case is not connected to the port 80. The port 80 opens into the detection space 52 so that intake air from the pressure pipe 74 can enter the detection space 52 for purposes of pressurizing the detection space 52.

The features of the invention disclosed in the present description, in the drawings and in the claims may be essential both individually and in any desired combinations for the realization of the invention in its various embodiments. The invention may be varied within the scope of the claims and in view of the knowledge of the person skilled in the art.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An internal combustion engine comprising:

a fuel tank;

a fluid-carrying component;

a tank ventilation line fluidly connecting the fuel tank and the fluid-carrying component;

a valve arranged in the tank ventilation line;

a detection subarea of the valve being surrounded by the fluid-carrying component such that a detection space is formed around the detection subarea, the detection space having at least one inlet opening via which the detection space is pressurized; and at least one pressure sensor to monitor the pressure in the detection space, wherein the at least one inlet opening is connected to a pressure line that is separate from the tank ventilation line, such that the pressure line pressurizes the detection space.

2. The internal combustion engine according to claim 1, wherein the fluid-carrying component is an intake hood or a compressor of an exhaust gas turbocharger.

3. The internal combustion engine according to claim 1, wherein the at least one inlet opening is formed by at least one passage opening in the valve.

4. The internal combustion engine according to claim 1, wherein a sealing element is provided in at least one gap adjacent to the detection space.

5. The internal combustion engine according to claim 1, wherein a scavenging air pump is provided in the tank ventilation line and/or wherein another pressure sensor is arranged in the tank ventilation line.

6. The internal combustion engine according to claim 1, wherein the valve is made of plastic.

7. The internal combustion engine according to claim 1, wherein the fluid-carrying component is positioned upstream of an exhaust gas turbocharger and a throttle valve, wherein the exhaust gas turbocharger is fluidly connected to the throttle valve by a pressure pipe and wherein the pressure line, that is connected to the at least one inlet opening, is branched off from the pressure pipe at a position between the exhaust gas turbocharger and the throttle valve.

8. The internal combustion engine according to claim 7, wherein the at least one pressure sensor is provided in the pressure pipe.

* * * * *